US008956185B2

(12) United States Patent
Lan et al.

(10) Patent No.: US 8,956,185 B2
(45) Date of Patent: Feb. 17, 2015

(54) ELECTRICAL CONNECTOR

(71) Applicant: Cheng Uei Precision Industry Co., Ltd, New Taipei (TW)

(72) Inventors: Rong-Qin Lan, Dong-Guan (CN); Yin-Lung Wu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 50 days.

(21) Appl. No.: 13/945,896

(22) Filed: Jul. 18, 2013

(65) Prior Publication Data

US 2015/0024631 A1 Jan. 22, 2015

(51) Int. Cl.
*H01R 13/648* (2006.01)
*H01R 13/6581* (2011.01)

(52) U.S. Cl.
CPC ..... *H01R 13/6581* (2013.01)
USPC ..... 439/607.13

(58) Field of Classification Search
USPC ..... 439/607.05, 607.13, 607.35, 607.36
See application file for complete search history.

(56) References Cited

U.S. PATENT DOCUMENTS 8,419,473 B1 * 4/2013 Lan et al. ..... 439/607.17
8,568,170 B2 * 10/2013 Lan et al. ..... 439/607.05
8,662,928 B1 * 3/2014 Xie et al. ..... 439/607.58

* cited by examiner

*Primary Examiner* — James Harvey
(74) *Attorney, Agent, or Firm* — Cheng-Ju Chiang

(57) ABSTRACT

An electrical connector includes an insulating housing having a receiving chamber of substantial U-shape with a top opening, an insulating body assembled to the insulating housing, a plurality of terminals disposed in the insulating body, and a shielding shell of substantial inverted-U shape with a top plate and two side plates. The shielding shell is covered on the insulating housing with the top plate covering the top opening of the receiving chamber and the side plates abutting against two opposite outsides of the receiving chamber. So the entire thickness of the electrical connector only depends on a bottom wall of the receiving chamber and the top plate of the shielding shell, and therefore, the electrical connector in this invention can realize a thinner thickness and can effectively reduce the appearance thickness of an electronic product where the electrical connector is used.

11 Claims, 7 Drawing Sheets

ELECTRICAL CONNECTOR

BACKGROUND OF THE INVENTION

1. Field of the Invention

The present invention relates to an electrical connector, and more particularly to an electrical connector which is thinner in thickness.

2. The Related Art

In the electronics industry, electronic products having light and thin characteristics are occupying a mainstream market. Because internal parts in the electronic product affect appearance and thickness of the electronic product, an electrical connector as one of the internal parts is accordingly required to have a thinner thickness.

Referring to FIG. 1, a conventional electrical connector 100' used in an electronic product (not shown) and adapted for mating with a plug connector (not shown) includes an insulating housing 10', an insulating body 30', a plurality of terminals 20' molded in the insulating body 30' by insert molding, and a shielding shell 40' looped from a metal plate to show a rectangular cylindrical shape. The insulating body 30' together with the terminals 20' is assembled in the insulating housing 10'. The insulating housing 10' defines a mating window 11' in the mating direction, through which the plug connector is inserted in the electrical connector 100'. An outer periphery of the mating window 11' protrudes outward to form a ring-shaped blocking rib 12'. The shielding shell 40' encloses the insulating housing 10' with a front periphery thereof resisting against the back of the blocking rib 12'.

When the electrical connector 100' is assembled in the electronic product, the blocking rib 12' is the only part directly exposed outside the electronic product. For beautifying the appearance of the electronic product, the blocking rib 12' can be changed in shape, material or color. However, the shielding shell 40' encloses the whole of the insulating housing 10'. As a result, the combination of thickness of the insulating housing 10' and the shielding shell 40' directly affects the entire thickness of the electrical connector 100', and further affects the appearance thickness of the electronic product. Therefore, an electrical connector which is thinner in thickness is required.

SUMMARY OF THE INVENTION

An object of the present invention is to provide an electrical connector which includes an insulating housing, an insulating body, a plurality of terminals disposed in the insulating body, and a shielding shell of substantial inverted-U shape. The insulating housing has a base body and a receiving chamber extending forward from a front face of the base body. The base body defines a passageway penetrating through the base body along a front-to-rear direction. The receiving chamber includes a bottom wall and two side walls which make the receiving chamber show a substantial U-shape with a top opening. The insulating body has a base portion and a tongue board extending forward from a front face of the base portion. The tongue board is divided into two parts of which a front part is designated as a mating part and a rear part is designated as a fixing part. The insulating body together with the terminals is assembled forward to the insulating housing, wherein the base portion is assembled in the rear of the base body, the mating part of the tongue board passes through the passageway to project in the receiving chamber, and the fixing part of the tongue board is fixed in the passageway of the base body. The shielding shell has a top plate and two side plates, and is covered on the insulating housing, wherein the top plate covers the top opening of the receiving chamber and apart faces the mating part of the tongue board and the bottom wall of the receiving chamber, and the side plates abut against two opposite outsides of the side walls of the receiving chamber.

As described above, the insulating housing defines the receiving chamber of substantial U-shape with the top opening and the shielding shell of substantial inverted-U shape with the top plate thereof covering the top opening of the receiving chamber, so that make the entire thickness of the electrical connector only depend on the bottom wall of the receiving chamber and the top plate of the shielding shell. Therefore, the electrical connector in this invention can realize a thinner thickness and can effectively reduce the appearance thickness of an electronic product where the electrical connector is used.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
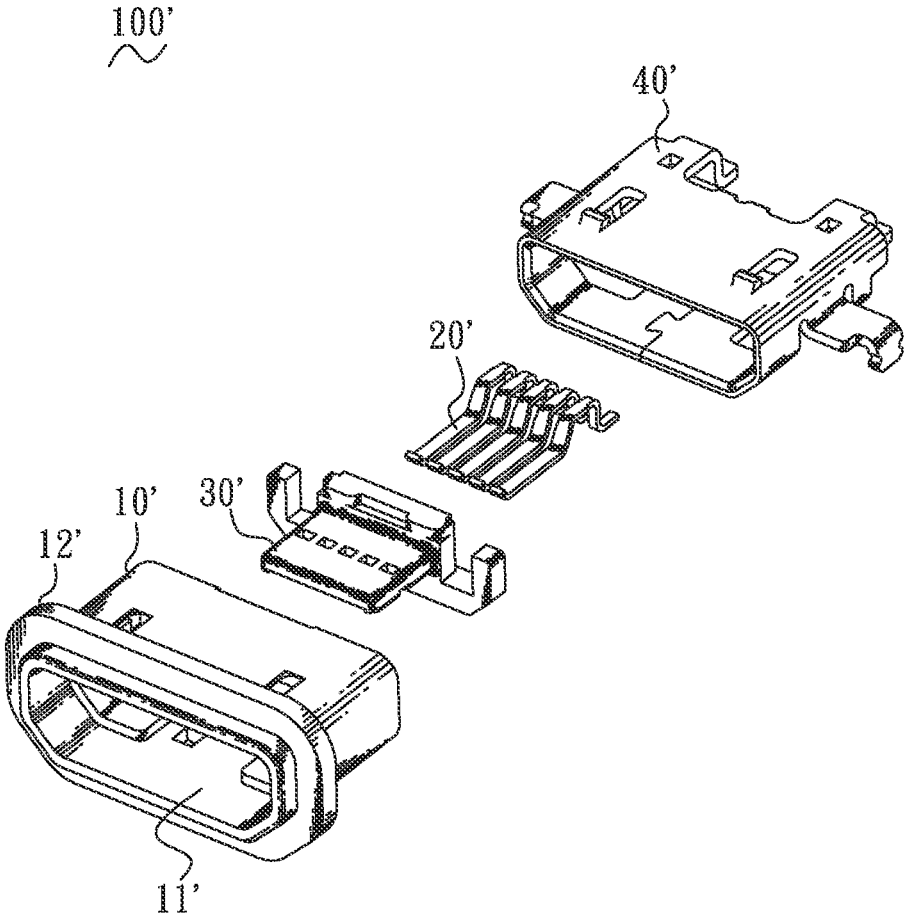
FIG. 1 (Prior Art)
FIG. 1 is an exploded perspective view of a conventional electrical connector.

Referring to FIGS. 2-7, an electrical connector 1 according to an embodiment of the present invention is adapted for engaging with a plug connector (not shown). The electrical connector 1 includes an insulating housing 20, an insulating body 30, a plurality of terminals 10 disposed in the insulating body 30, and a shielding shell 40.

The insulating housing 20 has a base body 21 and a receiving chamber 22 extending forward from a front face of the base body 21. The base body 21 defines a passageway 213 penetrating through the base body 21 along a front-to-rear direction. The receiving chamber 22 includes a bottom wall 221 and two side walls 222 which make the receiving chamber 22 show a substantial U-shape with a top opening 220.

The insulating body 30 has a base portion 31 and a tongue board 34 extending forward from a front face of the base portion 31. The tongue board 34 is divided into two parts of which a front part is designated as a mating part 340 and a rear part is designated as a fixing part 341. The insulating body 30 together with the terminals 10 is assembled forward to the insulating housing 20. In detail, the base portion 31 is assembled in the rear of the base body 21, the mating part 340 of the tongue board 34 passes through the passageway 213 to project in the receiving chamber 22, and the fixing part 341 of the tongue board 34 is fixed in the passageway 213 of the base body 21.

The shielding shell 40 is of substantial inverted-U shape, and has a top plate 41 and two side plates 42. The shielding shell 40 is covered on the insulating housing 20. In detail, the top plate 41 covers the top opening 220 of the receiving chamber 22 and apart faces the mating part 340 of the tongue board 34 and the bottom wall 221 of the receiving chamber 22, and the side plates 42 abut against two opposite outsides of the side walls 222 of the receiving chamber 22.

Referring to FIG. 3, FIG. 5, FIG. 6 and FIG. 7, the bottom wall 221 of the receiving chamber 22 levelly extends forward from a bottom edge of the front face of the base body 21. The side walls 222 vertically extend forward from two side edges of the front face of the base body 21. Front edges of the side walls 222 of the receiving chamber 22 are spread outward to form blocking walls 223 which are flush with front faces of the receiving chamber 22. Front edges of the side plates 42 of the shielding shell 40 resist against the back of the blocking walls 223. A front edge of the top plate 41 cooperates with the front faces of the receiving chamber 22 to together define a mating window 50 through which the plug connector is inserted between the receiving chamber 22 and the top plate 41 and mated with the mating part 340 of the tongue board 34 so as to electrically connect with the terminals 10.

Outer edges of the blocking walls 223 protrude rearward to symmetrically form a pair of inverted-L shaped breast walls 224. A pair of inserting slots 225 is accordingly formed between the breast walls 224 and the corresponding side walls 222. Each inserting slot 225 is protruded with a fastening block 226 at a substantial middle of a vertical part thereof. The front edges of the side plates 42 of the shielding shell 40 define a fastening gap 421 respectively. Front ends of the side plates 42 are inserted in the inserting slots 225 with the fastening blocks 226 being snapped in the fastening gaps 421 respectively.

Two sides of a bottom of a rear face of the base body 21 are concaved forward to form a pair of symmetrical L-shaped fastening grooves 210 of which level parts penetrate through a bottom face and two opposite side faces of the base body 21. Two sides of a top edge of the rear face of the base body 21 are concaved forward to form a pair of chutes 217 inclined upward to a top face of the base body 21 in the process of extending forward. The top face of the base body 21 further defines a pair of locking fillisters 216 located in front of the chutes 217 respectively. Rear ends of bottom edges of the side plates 42 of the shielding shell 40 are bent inward and then upward to form a pair of fastening hooks 423. Two sides of a rear of the top plate 41 are punched downward to form a pair of elastic slices 411. The shielding shell 40 is assembled forward to the insulating housing 20 until the elastic slices 411 slide through the chutes 217 to be buckled in the locking fillisters 216 and the fastening hooks 423 are snapped in the fastening grooves 210.

Substantial middles of the side plates 42 of the shielding shell 40 protrude inward to form a pair of fastening strips 420 each extending along a front-to-rear direction. The two opposite outsides of the side walls 222 of the insulating housing 20 define a pair of guiding channels 227 extending along a front-to-rear direction and further penetrating rearward through the two side faces and the rear face of the base body 21. In this embodiment, the guiding channels 227 are in alignment with the fastening blocks 226 respectively. The shielding shell 40 is assembled forward by the fastening strips 420 sliding along the guiding channels 227. Preferably, a rear end of each guiding channel 227 is gradually enlarged to define an entry guide 228 for guiding the fastening strips 420 to slide into the guiding channels 227.

Two inside joints of the bottom wall 221 and the side walls 222 of the receiving chamber 22 are protruded with a lead slope 229 respectively for avoiding a misinsertion of the plug connector. The top plate 41 of the shielding shell 40 has a front thereof opened with a pair of locking holes 410 for firmly locking the plug connector in the electrical connector 1. The bottom edges of the side plates 42 of the shielding shell 40 are bent outward to form a plurality of fixing slices 422.

Referring to FIG. 3, FIG. 4, FIG. 5 and FIG. 6, a substantial middle of the rear face of the base body 21 of the insulating housing 20 is concaved forward to form a holding cavity 211 between the fastening grooves 210. Two inner sides of the holding cavity 211 are concaved oppositely outward to form a pair of sliding channels 212 penetrating rearward through the rear face of the base body 21. The passageway 213 has a rear end thereof communicated with a front end of the holding cavity 211. Two opposite side faces of the base portion 31 of the insulating body 30 protrude sideward to form a pair of slide blocks 32 sliding forward along the sliding channels 212 to assemble the base portion 31 in the holding cavity 211. The holding cavity 211 penetrates upward through the top face of the base body 21. A top of the base portion 31 protrudes upward to form a protrusion 33. A rear edge of the top plate 41 of the shielding shell 40 defines a buckling gap 412 for buckling the protrusion 33 of the base portion 31 therein.

A bottom innerwall of the passageway 213 of the insulating housing 20 protrudes upward to form a first buckling wedge 215. A top wall of the passageway 213 is opened with a buckling hole 214 between the locking fillisters 216. The fixing part 341 of the tongue board 34 of the insulating body 30 has a top side thereof protruded with a second buckling wedge 342 thereon, and a bottom side thereof opened with a buckling groove 343. The fixing part 341 of the tongue board 34 is fixed in the passageway 213 of the base body 21 by way of the first buckling wedge 215 being buckled in the buckling groove 343 and the second buckling wedge 342 being buckled in the buckling hole 214. So the insulating body 30 can be firmly assembled to the insulating housing 20.

Figure 2:
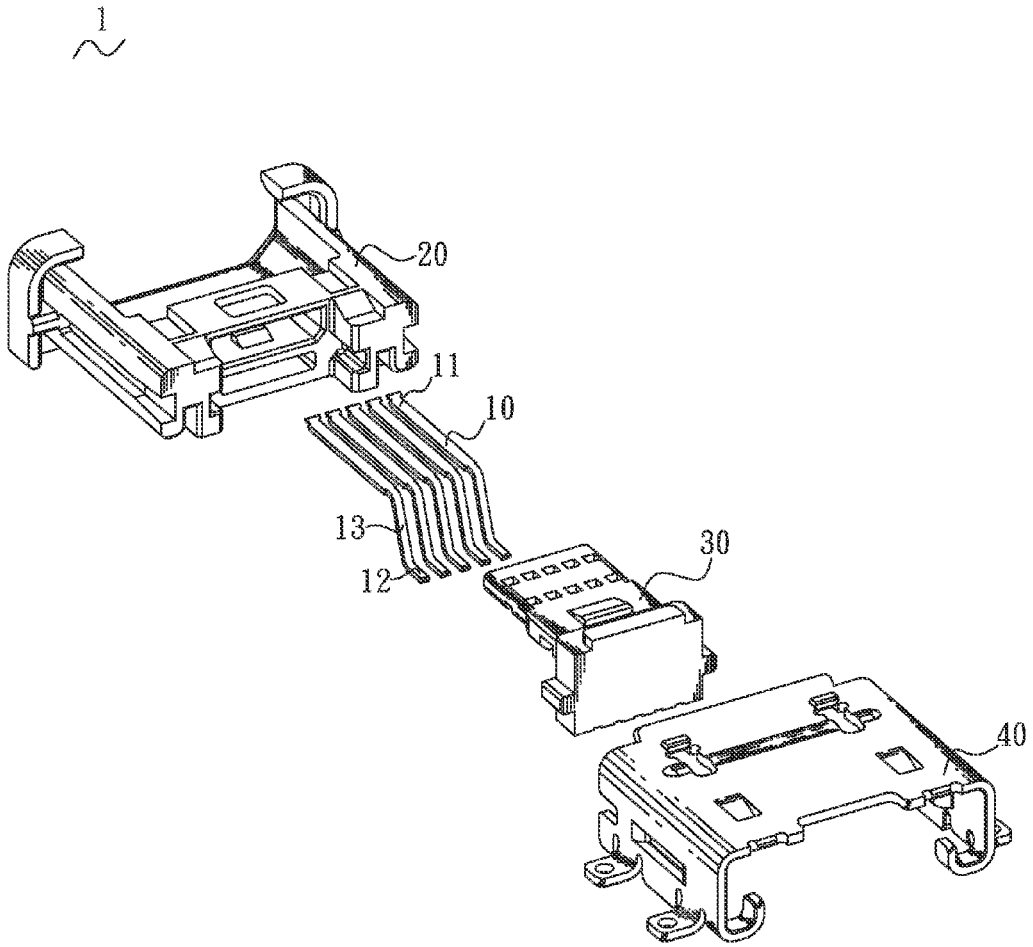
FIG. 2 is an exploded perspective view of an electrical connector according to an embodiment of the present invention.
Figure 3:
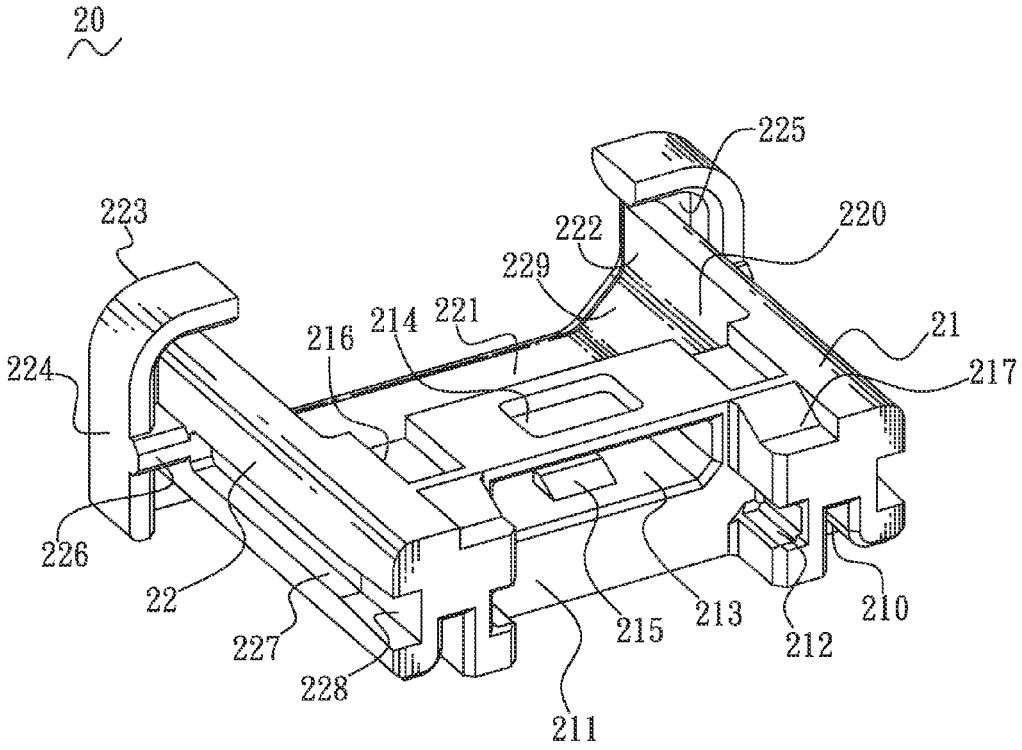
FIG. 3 is a perspective view of an insulating housing of the electrical connector of FIG. 2.
Figure 4:
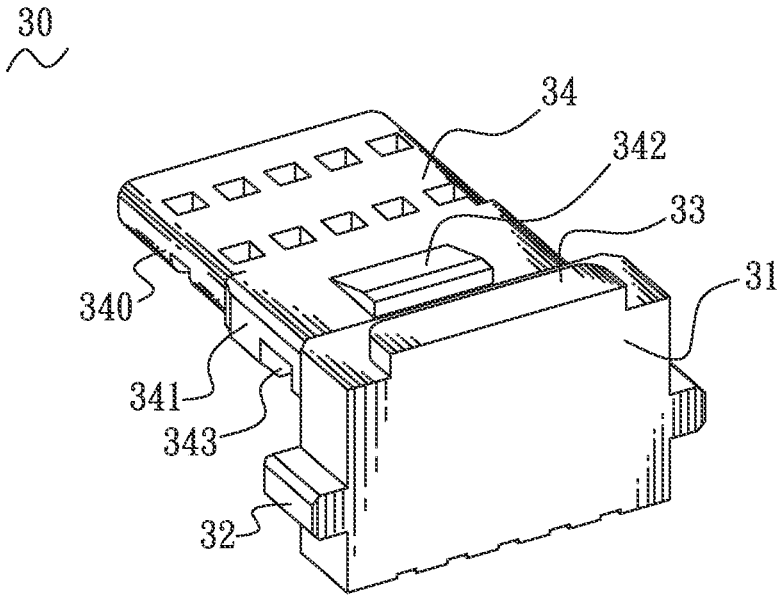
FIG. 4 is a perspective view of an insulating body of the electrical connector of FIG. 2.
Figure 5:
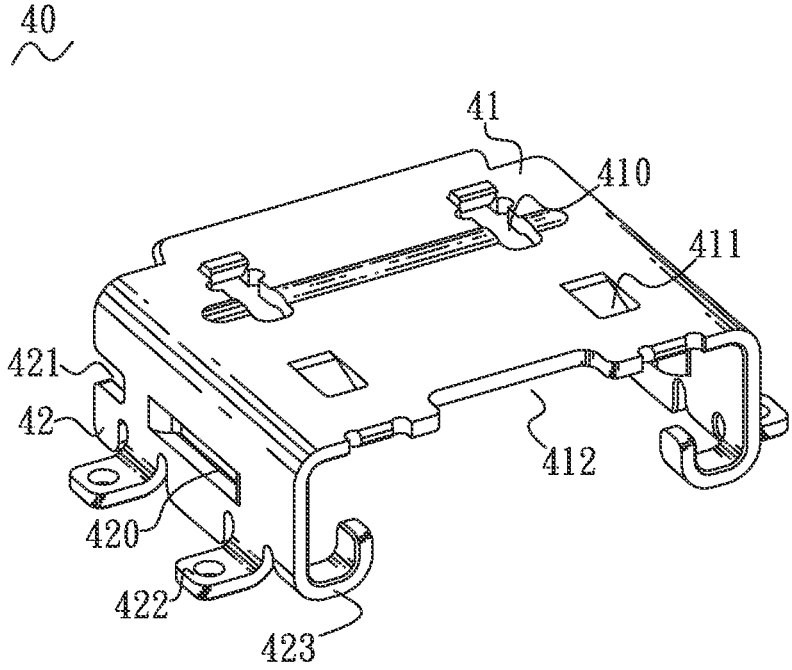
FIG. 5 is a perspective view of a shielding shell of the electrical connector of FIG. 2.
Figure 6:
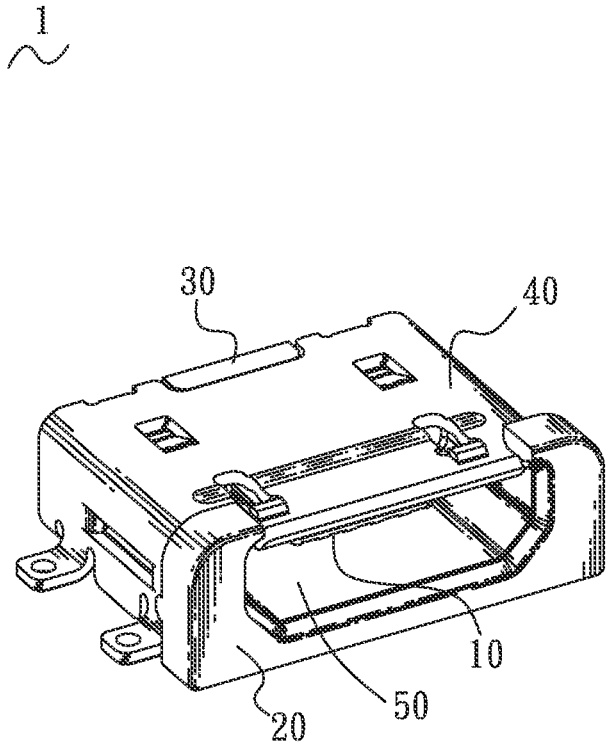
FIG. 6 is an assembled perspective view of the electrical connector of FIG. 2.
Figure 7:
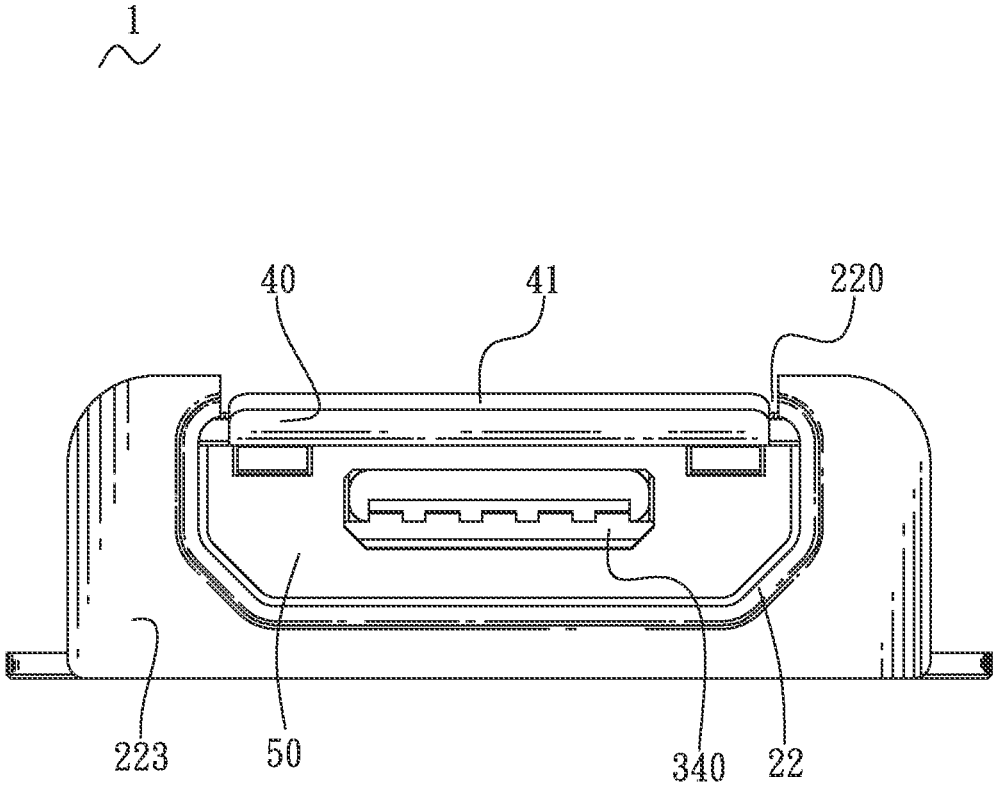
FIG. 7 is a front view of the electrical connector of FIG. 6.

Referring to FIG. 2, FIG. 4 and FIG. 7, each of the terminals 10 has a contact arm 11, a soldering tail 12 and a connecting arm 13 connected between the contact arm 11 and the soldering tail 12 to make the terminal 10 show a substantial Z-shape. In this embodiment, the terminals 10 are molded in the insulating body 30 by insert molding. In detail, the connecting arms 13 are embedded in the base portion 31, the soldering tails 12 project behind the base portion 31, and the contact arms 11 are molded in the tongue board 34 with front ends thereof being exposed in a bottom face of the mating part 340 of the tongue board 34 for electrically contact with the plug connector.

As described above, the insulating housing 20 defines the receiving chamber 22 of substantial U-shape with the top opening 220 and the shielding shell 40 of substantial inverted-U shape with the top plate 41 thereof covering the top opening 220 of the receiving chamber 22, so that make the entire thickness of the electrical connector 1 only depend on the bottom wall 221 of the receiving chamber 22 and the top plate 41 of the shielding shell 40. Therefore, the electrical connector 1 in this invention can realize a thinner thickness and can effectively reduce the appearance thickness of an electronic product (not shown) where the electrical connector 1 is used.

What is claimed is:

1. An electrical connector, comprising:

an insulating housing having a base body and a receiving chamber extending forward from a front face of the base body, the base body defining a passageway penetrating through the base body along a front-to-rear direction, the receiving chamber including a bottom wall and two side walls which make the receiving chamber show a substantial U-shape with a top opening;

an insulating body having a base portion and a tongue board extending forward from a front face of the base portion, the tongue board being divided into two parts of which a front part is designated as a mating part and a rear part is designated as a fixing part;

a plurality of terminals disposed in the insulating body, the insulating body together with the terminals being assembled forward to the insulating housing, wherein the base portion is assembled in the rear of the base body, the mating part of the tongue board passes through the passageway to project in the receiving chamber, and the fixing part of the tongue board is fixed in the passageway of the base body; and a shielding shell of substantial inverted-U shape having a top plate and two side plates, the shielding shell being covered on the insulating housing, wherein the top plate covers the top opening of the receiving chamber and apart faces the mating part of the tongue board and the bottom wall of the receiving chamber, the side plates abut against two opposite outsides of the side walls of the receiving chamber.

2. The electrical connector as claimed in claim 1, wherein the bottom wall of the receiving chamber levelly extends forward from a bottom edge of the front face of the base body, the side walls vertically extend forward from two side edges of the front face of the base body.

3. The electrical connector as claimed in claim 1, wherein front edges of the side walls of the receiving chamber are spread outward to form blocking walls which are flush with front faces of the receiving chamber, front edges of the side plates of the shielding shell resist against the back of the blocking walls, a front edge of the top plate cooperates with the front face of the receiving chamber to together define a mating window.

4. The electrical connector as claimed in claim 3, wherein outer edges of the blocking walls protrude rearward to symmetrically form a pair of inverted-L shaped breast walls, a pair of inserting slots is accordingly formed between the breast walls and the corresponding side walls, each inserting slot is protruded with a fastening block at a substantial middle of a vertical part thereof, the front edges of the side plates of the shielding shell define a fastening gap respectively, front ends of the side plates are inserted in the inserting slots with the fastening blocks being snapped in the fastening gaps respectively.

5. The electrical connector as claimed in claim 3, wherein two sides of a bottom of a rear face of the base body are concaved forward to form a pair of symmetrical L-shaped fastening grooves of which level parts penetrate through a bottom face and two opposite side faces of the base body, two sides of a top edge of the rear face of the base body are concaved forward to form a pair of chutes inclined upward to a top face of the base body in the process of extending forward, the top face of the base body further defines a pair of locking fillisters located in front of the chutes respectively, rear ends of bottom edges of the side plates of the shielding shell are bent inward and then upward to form a pair of fastening hooks, two sides of a rear of the top plate are punched downward to form a pair of elastic slices, the shielding shell is assembled forward to the insulating housing until the elastic slices slide through the chutes to be buckled in the locking fillisters and the fastening hooks are snapped in the fastening grooves.

6. The electrical connector as claimed in claim 5, wherein substantial middles of the side plates of the shielding shell protrude inward to form a pair of fastening strips each extending along a front-to-rear direction, the two opposite outsides of the side walls of the insulating housing define a pair of guiding channels extending along a front-to-rear direction and further penetrating rearward through the two side faces and the rear face of the base body, the shielding shell is assembled forward by the fastening strips sliding along the guiding channels.

7. The electrical connector as claimed in claim 6, wherein a rear end of each guiding channel is gradually enlarged to define an entry guide for guiding the fastening strips to slide into the guiding channels.

8. The electrical connector as claimed in claim 1, wherein two inside joints of the bottom wall and the side walls of the receiving chamber are protruded with a lead slope respectively.

9. The electrical connector as claimed in claim 1, wherein a rear face of the base body of the insulating housing is concaved forward to form a holding cavity, two inner sides of the holding cavity are concaved oppositely outward to form a pair of sliding channels penetrating rearward through the rear face of the base body, the passageway has a rear end thereof communicated with a front end of the holding cavity, two opposite side faces of the base portion of the insulating body protrude sideward to form a pair of slide blocks sliding forward along the sliding channels to assemble the base portion in the holding cavity.

10. The electrical connector as claimed in claim 9, wherein the holding cavity penetrates upward through a top face of the base body, a top of the base portion protrudes upward to form a protrusion, a rear edge of the top plate of the shielding shell defines a buckling gap for buckling the protrusion of the base portion therein.

11. The electrical connector as claimed in claim 1, wherein a bottom innerwall of the passageway of the insulating housing protrudes upward to form a first buckling wedge, a top wall of the passageway is opened with a buckling hole, the fixing part of the tongue board of the insulating body has a top side thereof protruded with a second buckling wedge thereon, and a bottom side thereof opened with a buckling groove, the fixing part of the tongue board is fixed in the passageway of the base body by way of the first buckling wedge being buckled in the buckling groove and the second buckling wedge being buckled in the buckling hole.

* * * * *